US005174764A

United States Patent [19]

Kandybowski et al.

[11] Patent Number: 5,174,764

[45] Date of Patent: Dec. 29, 1992

[54] CONNECTOR ASSEMBLY HAVING SURFACE MOUNTED TERMINALS

[75] Inventors: Steven J. Kandybowski, Tower City; Matthew M. Sucheski, Harrisburg, both of Pa.

[73] Assignee: AMP Incorporated, Harrisburg, Pa.

[21] Appl. No.: 812,253

[22] Filed: Dec. 20, 1991

[51] Int. Cl.[5] ..... H01R 9/09

[52] U.S. Cl. ..... 439/83; 439/81; 439/95; 439/876

[58] Field of Search ..... 439/78, 80–83, 439/92, 95, 876

[56] References Cited

U.S. PATENT DOCUMENTS

| | | | |
|---|---|---|---|
| 4,616,893 | 10/1986 | Feldman | 439/83 |
| 4,682,829 | 7/1987 | Kunkle et al. | 439/83 |
| 4,828,503 | 5/1989 | Gilissen et al. | 439/62 |
| 4,895,521 | 1/1990 | Grabbe | 439/63 |
| 4,898,539 | 2/1990 | Glover et al. | 439/81 |
| 4,975,084 | 12/1990 | Fedder et al. | 439/608 |
| 4,978,308 | 12/1990 | Kaufman | 439/83 |
| 4,998,887 | 3/1991 | Kaufman et al. | 439/78 |
| 5,104,324 | 4/1992 | Grabbe et al. | 439/83 |

*Primary Examiner*—Paula A. Bradley

[57] ABSTRACT

A connector (22) includes a housing (24) having an array of first terminal-receiving passageways (34) each in communication with a spring arm receiving recess (38), each passageway (34) having a terminal member (50) disposed therein. Each terminal member (50) includes a body section (52) having a first connecting portion (54) adapted for surface mount engagement with a circuit pad (122) of a circuit board (120) and a spring arm portion (60). The spring arm portion (60) has a first transverse portion (62) extending laterally from the terminal member (50) proximate the first connecting portion (54), an axial portion (64) of a selected length extending from the first transverse portion (62) and toward a second connecting portion (72) of the terminal member (50), and a second transverse portion (68) extending toward the body section (52). The first transverse portion (62) extends essentially parallel to the mounting face (28) and is recessed therefrom. The second transverse portion (68) is adapted to engage with a biasing surface 44 of the recess (38) such that upon mounting the connector (22) to board (120) the biasing surface (44) exerts pressure thereagainst to bias the first connecting section (54) against the circuit pad (122), the spring arm (60) providing increased normal force to the contact interface while remaining outside the path of the flow of current between the terminal member (50) and the circuit pad (122).

4 Claims, 9 Drawing Sheets

CONNECTOR ASSEMBLY HAVING SURFACE MOUNTED TERMINALS

FIELD OF THE INVENTION

This invention relates to circuit board connectors and more particularly to an improved surface mountable terminal for use in high density connector systems.

BACKGROUND OF THE INVENTION

With the ever increasing need for providing higher and increased speeds of electronic assembly circuitry, there is increasing interest in using the surface mount terminals since this eliminates the need for holes through the circuit board and the space considerations associated therewith. It is further desirable that the surface mount terminals have mechanically compliant sections, such as a spring section, to assure a sufficient normal force between the mating terminal and circuit pad. It is further desirable to provide terminal members that can be assembled in a dense array. In high speed interconnections, however, it is also desirable to provide as short as possible electrical path through the terminal members.

One type of spring arm terminal known in the art has an "open spring", which provides the increased compliancy but greatly increases the length of the electrical path.

U.S. Pat. No. 4,898,539 shows one example of a surface mount pin terminal having a compliant pin section having one end thereof attached to a body portion of the terminal and extending to a contact surface proximate the second end of the spring and further including a stub portion at the end of the spring. When the terminal is in its mated position the stub is forced against a body portion of the spring thereby providing a circular path or "closed loop". Other "closed loop" designs are shown in U.S. Pat. No. 4,895,521, which discloses a C-shaped type pin extending from a body portion of the terminal to provide resiliency, the end of the C-shape again being engaged to form a "closed loop" with the terminal body and in U.S. Pat. No. 4,998,887, which discloses terminal in which the free end of the spring is brought into engagement with the body of the terminal when the connector is mounted to the circuit board. While "closed loop" designs provide more than one current path, the problems associated with maintaining manufacturing tolerances within the required range are increased.

It is desirable, therefore, to have a spring arm terminal that has the increased compliancy of the spring without increasing the length of the current path nor affecting the range of manufacturing and assembly tolerances.

SUMMARY OF THE INVENTION

The present invention is directed to a connector assembly having first terminal members that are surface mountable and include spring arm portions that increase the normal force between the mating terminal and the circuit pad while remaining remote from the current path between the circuit board and terminal. The connector housing means includes an array of at least first terminal-receiving passageways extending from a mating to a mounting face, each passageway having at least a first spring arm receiving recesses in a communication therewith and adjacent to the mounting face. The first terminal members include an axially extending body section having first and second opposed ends defining first and second contact sections. The first contact section is adapted for surface mount engagement with a contact pad of a circuit board and the second contact section is adapted to mate with a corresponding terminal member of a mating connector. The first terminal members are disposed in the first passageways of the housing such that the first contact sections extend slightly beyond the mounting face of the connector for engagement with circuits of a circuit board. Each first terminal member further includes a stop means cooperable with stop means within the passageway to prevent axial movement of the first terminal member from the mounting to mating faces. The spring arm section of each terminal member includes a first transverse portion extending laterally from the first end of the body section,, an axial portion of a selected length extending toward the second end from the first transverse portion and a second transverse portion extending toward the body section. The first transverse portion extends outwardly a selected distance from the first contact section and is essentially parallel to the mounting face and recessed therefrom. The second transverse portion is adapted to engage a biasing surface within the housing and to transmit the bias force through the spring member to the first contact section. Upon disposing the terminal within the housing passageway and mounting the connector to a circuit board the first contact section of the terminal is directly engageable with the circuit path and the spring arm member is remote from the path of the circuit while providing increased force between the mating interface.

It is an object of the present invention to provide a surface mount terminal having the shortest possible electrical path between a circuit board and a mating connector and concomitantly therewith include a spring biasing means to increase the normal force at the mounting interface.

It is also an object of the present invention to provide a surface mount terminal and connector system that is suitable for use in a high speed applications wherein the connectors include ground means disposed between adjacent rows of signal terminal members to minimize cross talk.

It is a further object of the invention to provide a surface mount terminal that has the increased compliancy of a spring arm without increasing the length of the current path nor affecting the range of manufacturing and assembly tolerances.

Embodiments of the present invention will now be described by way of example with reference to the accompanying drawings.

DETAILED DESCRIPTION OF THE DRAWINGS

For purposes of illustrating the terminal of the present invention and the connector associated therewith, the terminal is being shown in a connector that includes grounding means for minimizing cross talk between adjacent signal terminals. It is to be understood that the surface mount terminal can also be used in connectors without such ground plane.

Figure 3:
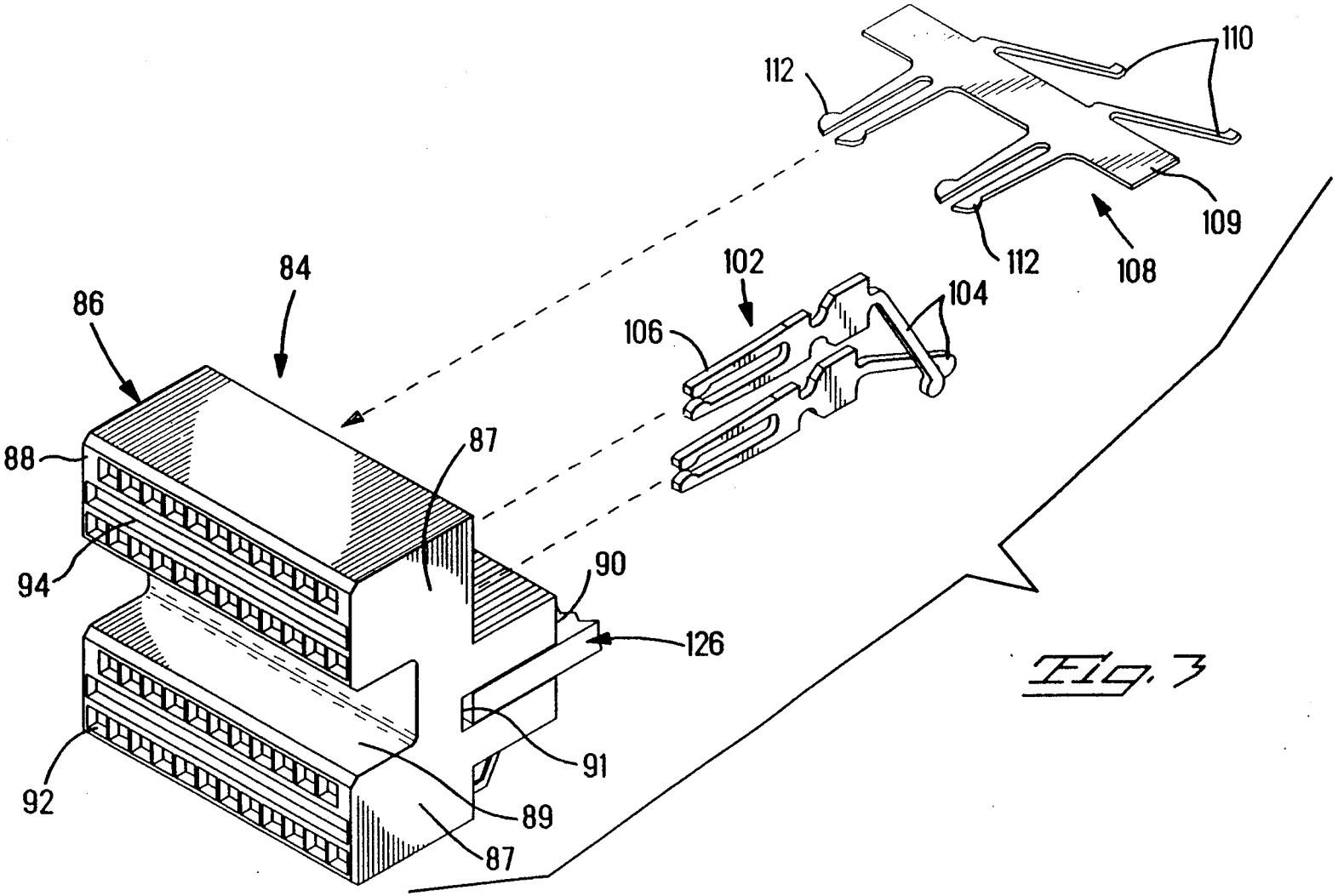
FIG. 3 is an enlarged view of the mating half of the connector assembly of FIG. 1 with the terminal members exploded therefrom.
Figure 4:
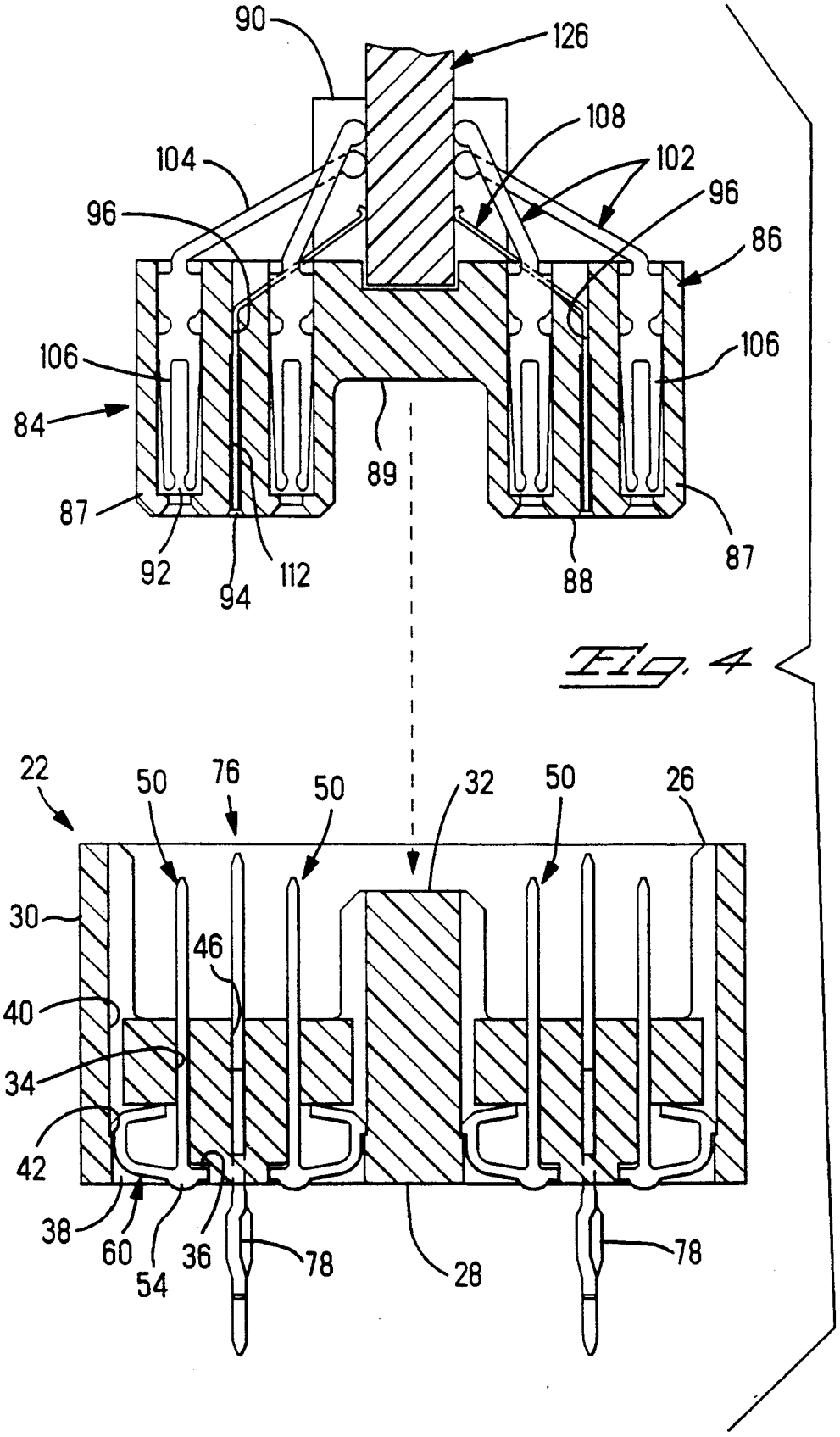
FIG. 4 is a cross sectional view of connector assembly of FIG. 1 with the connectors exploded from each other.
Figure 6:
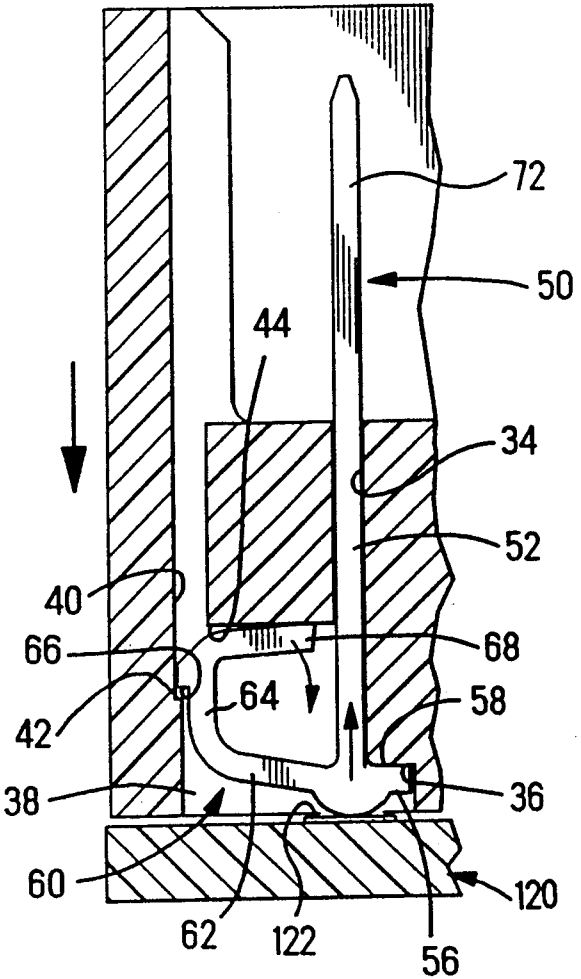
FIG. 6 is a view similar to that of FIG. 5 after the connector has been mounted to the board.
Figure 5:
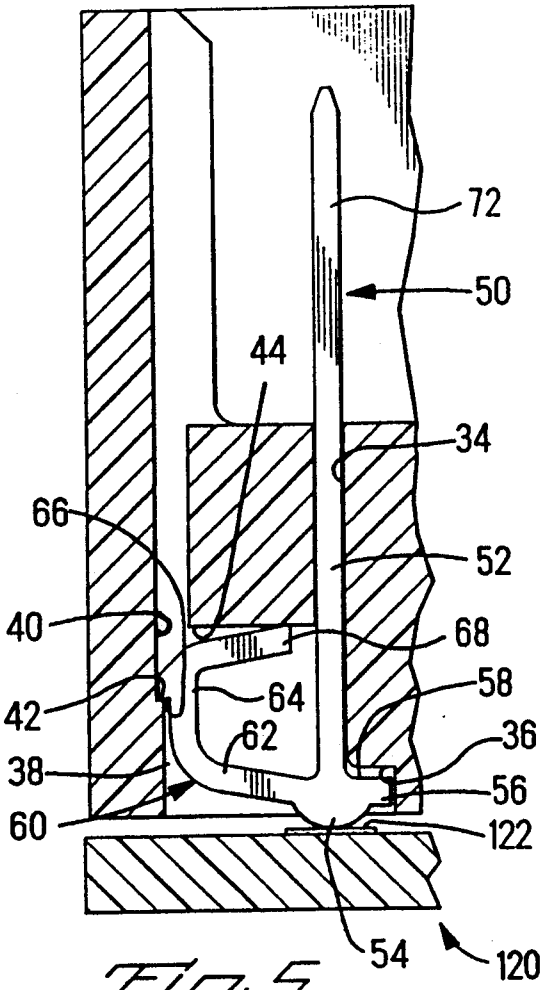
FIG. 5 is an enlarged fragmentary view of one of the terminal members disposed in the housing, mounted to a circuit board prior to full engagement therewith.

Referring now to FIGS. 1, 2, 3 and 4, connector assembly 20 includes a first or header connector 22 and a second or mating connector 84. Header connector 22 includes a housing 24 having opposed mating and mounting faces 26,28, a base 29, opposed outer side walls 30, and a center wall 32. Housing 24 includes a plurality of first terminal passageways 34 adapted to receive the first terminal members 50 and a plurality of second terminal-receiving slots 46 adapted to receive the second terminal members 76. Each first terminal passageway 34, as best seen in FIGS. 4, 5 and 6 includes a stop means 36 and a spring arm recess 38 having a vertical surface 40 including a retention means 42 and a biasing surface 44. First terminal members 50 include an axially extending body section 52 having first and second ends defining first and second contact sections 54,72. First contacting section 54 is adapted for surface mounting to a corresponding circuit pad 122 on a first circuit board 120 as best seen in FIGS. 5 and 6. Each first terminal member 50, in accordance with the invention, further includes a outwardly extending tab 56 having a stop surface 58 proximate the first contact portion 54 that cooperates with the corresponding stop means 36 within the housing 24 to stop axial movement in a direction from the mounting face 28 to the mating face 26 when the terminal member 50 is inserted into the housing passageway 34, as best seen in FIGS. 5 and 6. As is also seen in these Figures, the first terminal-receiving passageway 34 is configured to be just slightly larger than the cross-sectional dimension of the terminal body section 52 such that the terminal body section is slideably received within passageway 34.

Terminal spring arm section 60 includes a first transverse portion 62 extending laterally from the first end of the body section, an axial portion 64 of a selected length extending toward the second terminal end 72 and concludes in a second transverse portion 68 extending toward the terminal body section 52 and angled slightly toward the second end 72. The first transverse portion 62 extends outwardly a selected distance from the first contact section 54 and is essentially parallel to the mounting face 28 and is recessed therefrom. The second transverse portion 68 is adapted to engage with the biasing surface 44 in passageway recess 38 of the housing 24. The axially extending portion 64 includes a retention means 66 thereon, which cooperates with housing retention means 42 on wall surface 40 to stop axial movement of the spring arm 60 in a direction toward the mounting face 28. As can be seen in FIGS. 5 and 6 the free end of second transverse portion 68 is spaced from the terminal body portion 52 to allow the spring arm 60 to move compliantly toward the terminal member 50 during insertion of the terminal member 50 into the housing passageway 34. Upon full insertion of first terminal member 50 into the passageway 34, the leading end of the second transverse portion 68 moves away from the terminal body section 52 when the retention means 66 engages the housing retention surface 42. FIG. 6 shows the action of the terminal members 50 as the header 22 is mounted to the circuit board 120. As force is applied downwardly on header 22, an oppositely directed force pushes against the first contact section 54 until the stop surface 58 on tab 56 of the first terminal member 50 engages the stop means 36 within the housing passageway 34 thus restraining the terminal member 50 from moving axially toward the mating face 26. Concomitantly therewith the second transverse portion 68 receives a biasing force from the housing surface 44 within recess 38 which increases the pressure or normal force against the first contact section 54 to assure that the first contact section 54 of the first terminal member 50 remains securely engaged with the circuit pad 122 of the first circuit board 120.

Referring now to FIGS. 1, 2, 4 and 7 header member 22 further includes second terminal-receiving slots 46, as shown in FIG. 4, which are configured to receive the second terminal members 76 therein. As shown in these Figures, second terminal member 76 is a ground bus bar, which extends between the rows of first terminal members 50 and is adapted to be engaged with complimentary ground terminal members 108 in the mating connector 84. Second or ground terminal members 76 include first contact section 78 and a second contact section 82 which define slots extending from a leading edge 80 of the flat portion 77. Slots 82 are adapted to receive a pair of opposed beams 112 of terminal member 108 in the mating connector 84. The essentially planar configuration of the second terminal members 76 minimize the amount of space required for the terminal members 76, thereby facilitating use in high density connector systems.

Figure 1:
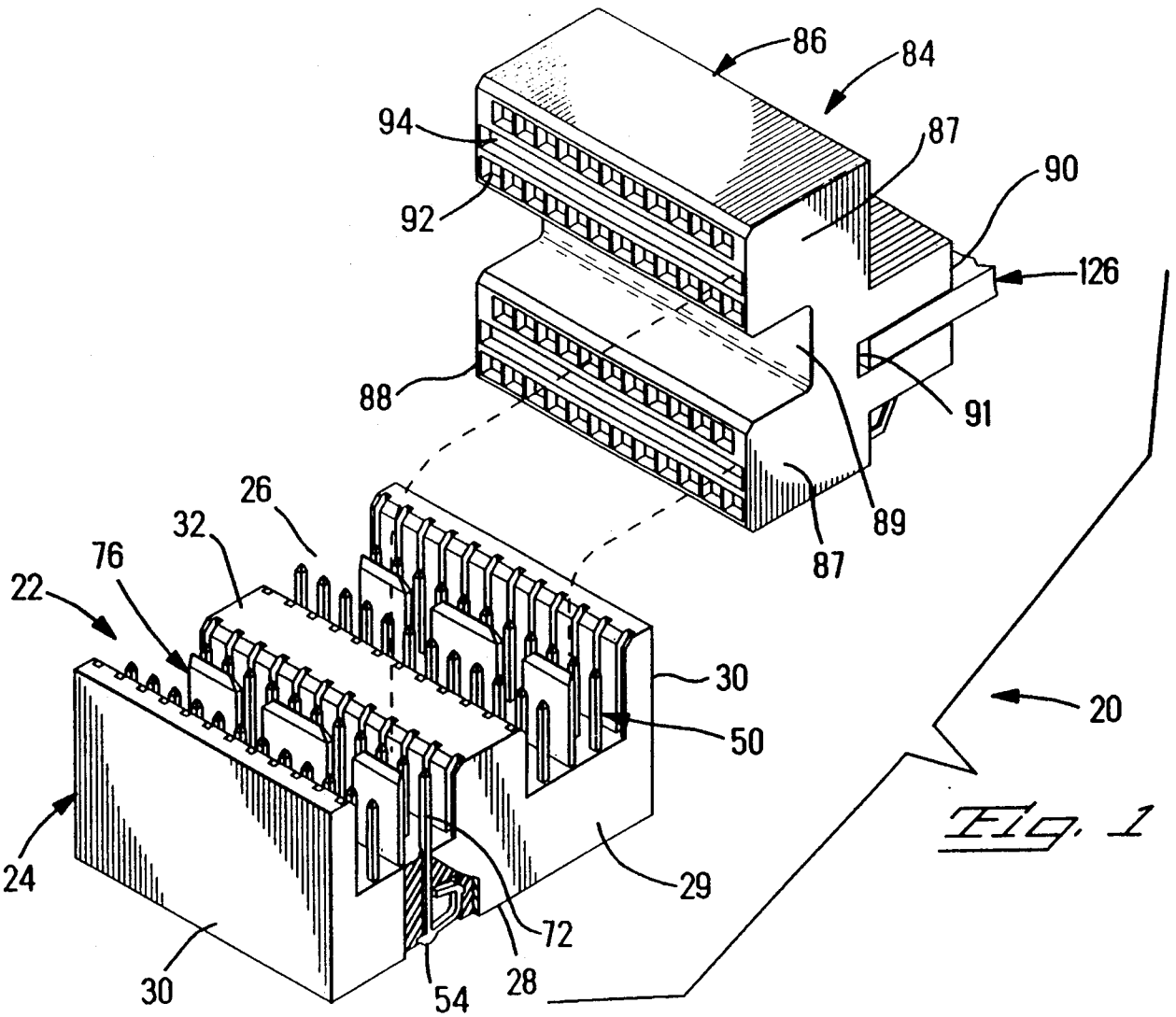
FIG. 1 is a perspective view illustrating a connector assembly made in accordance with the invention.
Figure 2:
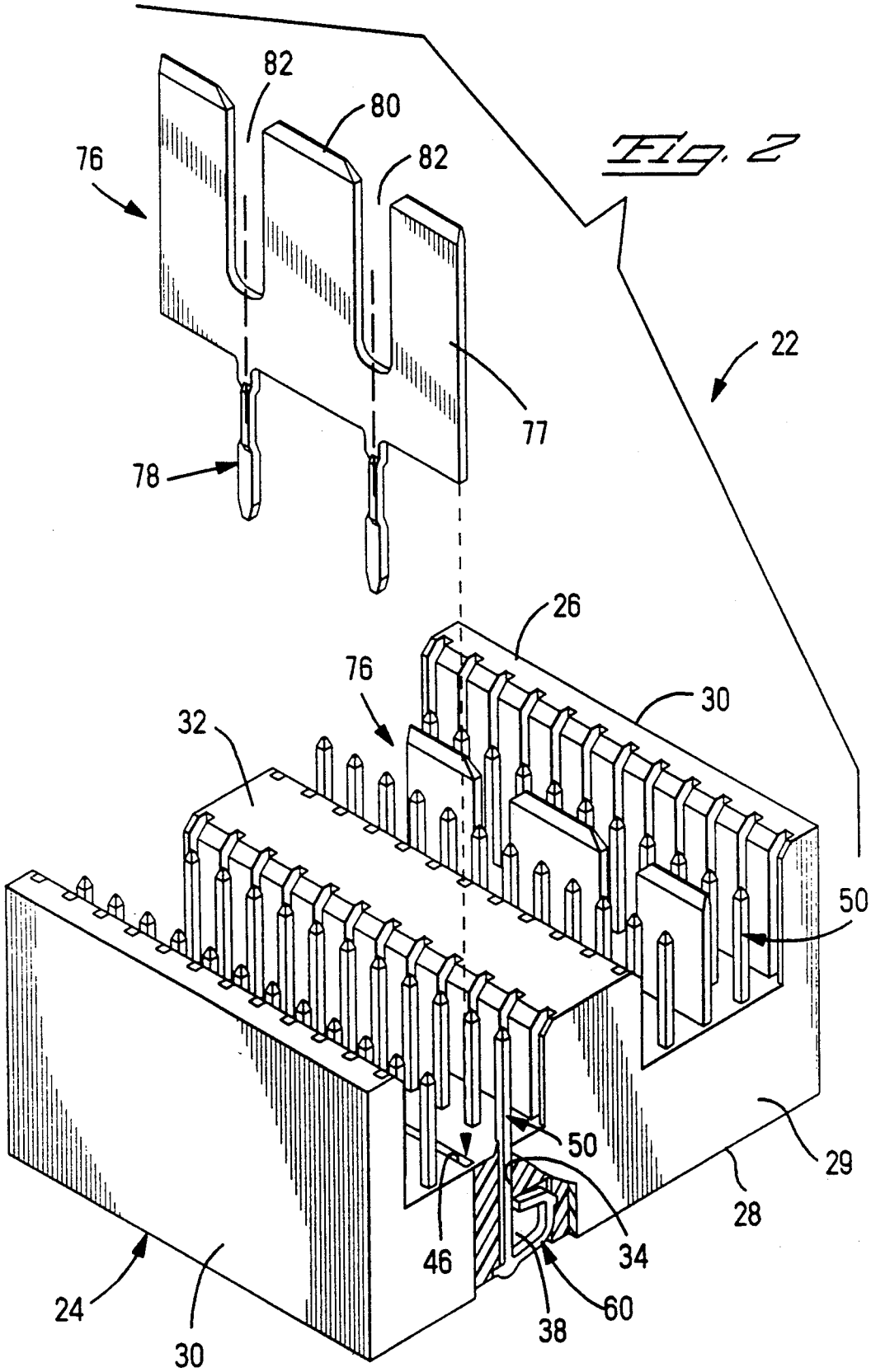
FIG. 2 is an enlarged partially exploded view of one of the mating connectors of FIG. 1 with one of the terminals exploded therefrom and a portion of the housing broken away to show the other terminal member.
Figure 7:
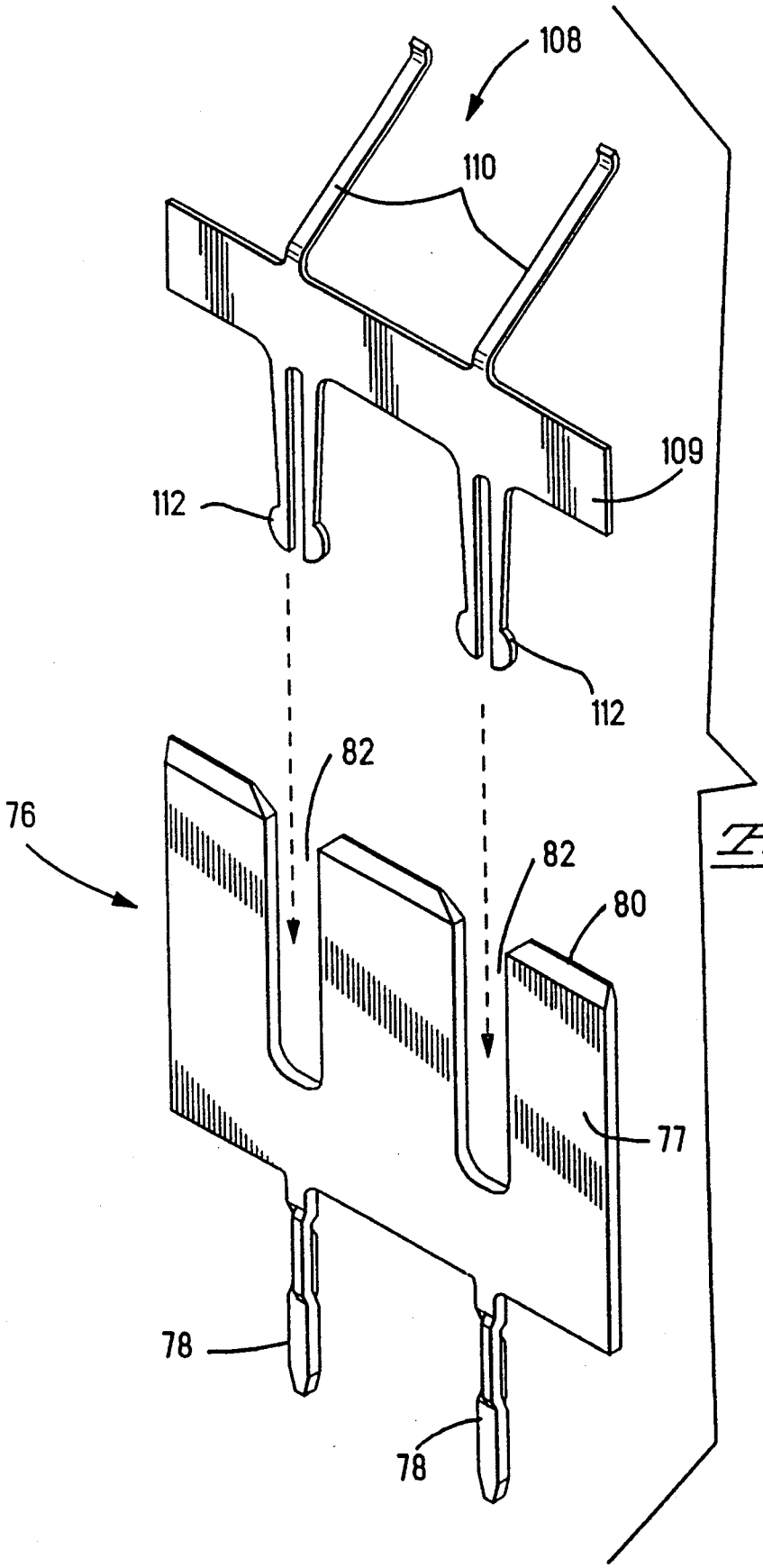
FIG. 7 is an exploded view of the ground terminals of the present invention.
Figure 8:
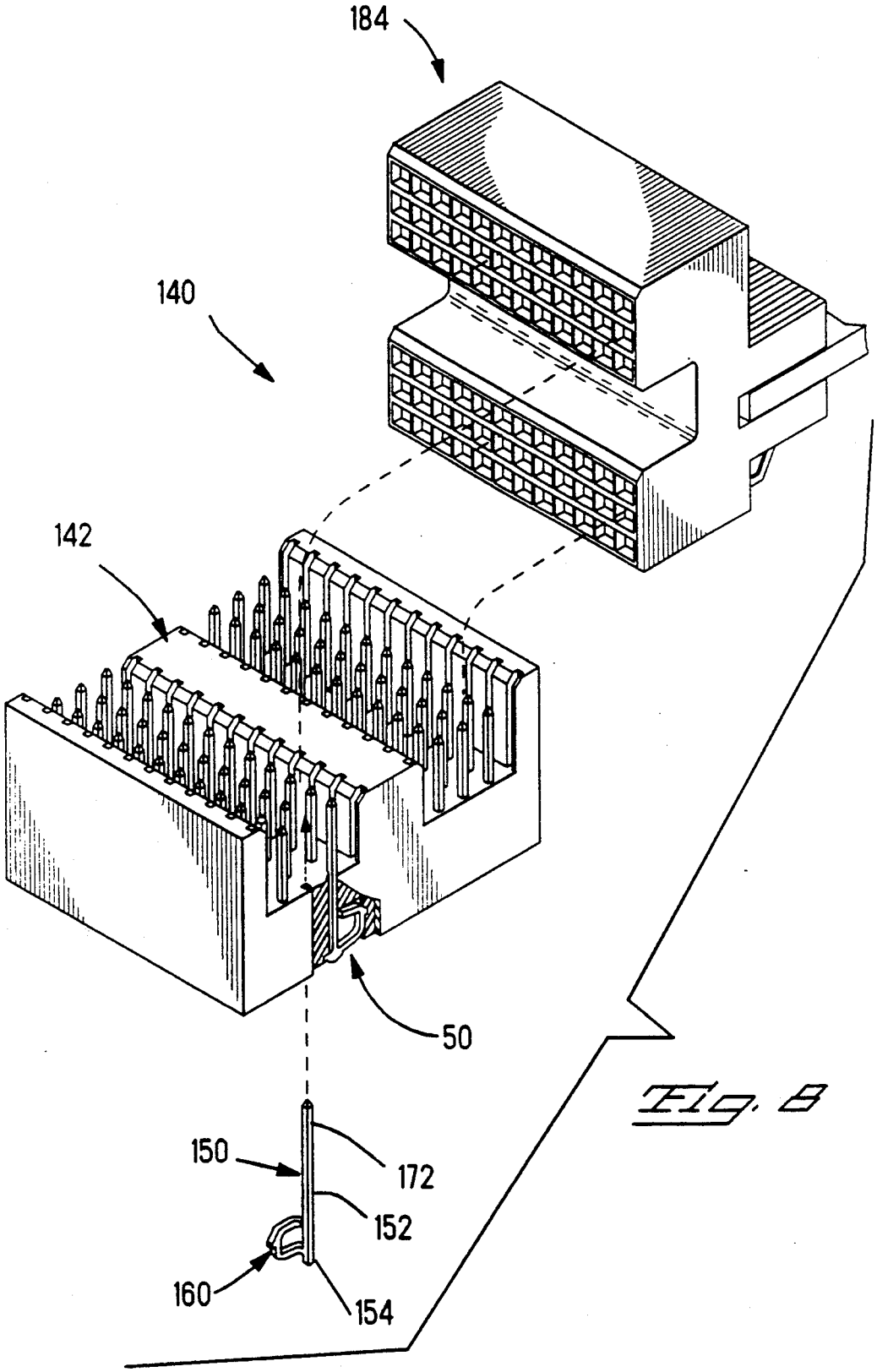
FIG. 8 is a perspective view illustrating an alternative embodiment of the connector assembly made in accordance with the invention.
Figure 9:
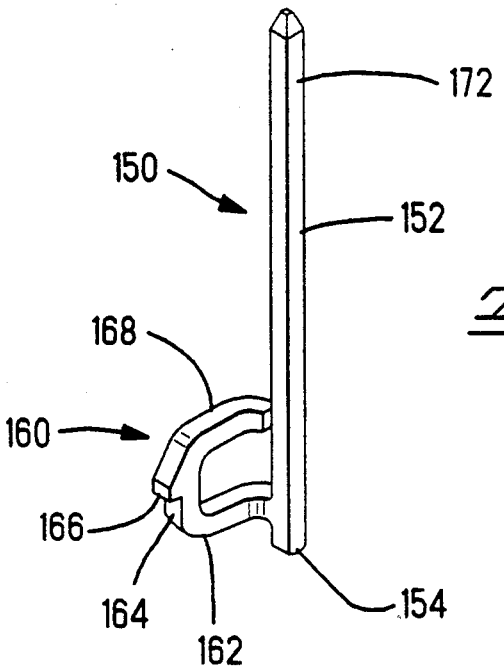
FIG. 9 is a perspective view of an alternate embodiment of the terminal made in accordance with the invention.

Referring now to FIGS. 1, 3 and 4, connector 84 includes a housing 86 having a mating face 88 and a board receiving face 90. As shown in these Figures the mating face 88 includes two housing portions 87 having a slot 89 extending therebetween. Each of the portions 87 include a plurality of third terminal-receiving passageways 92 extending therethrough and a plurality of fourth terminal-receiving passageways 96, as seen in FIG. 4, extending rearwardly from slot 94. The board receiving face 90 further includes a slot 91 for receiving the leading edge of a daughter card 126. Third terminal members 102 include first mating portions 104 adapted to be surface mounted to circuits (not shown) on daughter card 126 and second mating portions 106 comprising compliant beams for mating with corresponding ones of the first connecting portions 72 of the terminal members 50 in the header 22. Fourth terminal members 108 are the corresponding ground planes of the connector 84 and include first connecting sections 110 for mounting to the daughter card 126 and at least one pair of substantially planar opposed beams 112 extending from the opposite edge of a flat body section 109, which are received in the slots 82 in ground conductor 76 as best seen in FIG. 7. Again, the essentially planar configuration of the fourth terminal members 108 and the planar beams 112 minimize the amount of space required for the terminal members 108 and the space required for mating the second and fourth members 76,108, thereby facilitating use in high density connector systems. It is to be understood that the bus bar configuration shown herein is just one of many that may be used. The first connecting portions 104,110 of third and fourth terminal members 102,108 are adapted to be electrically engaged with corresponding signal and ground pads (not shown) on the daughter card 126 when the daughter card 126 is received in the card receiving slot 90 of connector 84. FIG. 4 also illustrates the high density arrangement of the various terminal members 50 and ground conductors 76.

Connector housings 24,86 can be made from any suitable dielectric materials as known in the art. The various terminal members are preferably made from copper alloys, such as beryllium copper or the like. The material selected is one having the desired electrical and spring characteristics.

As shown in the FIG. 4, the ground terminal members 76 also include compliant sections 78, which may be used to secure the header 22 to the board 120. Other members for securing the header to a mother board or back plane include the use of flanges with securing means, board lock members such as those disposed in flanges or within cavities (not shown) of the housing or other means known in the art.

Figure 10:
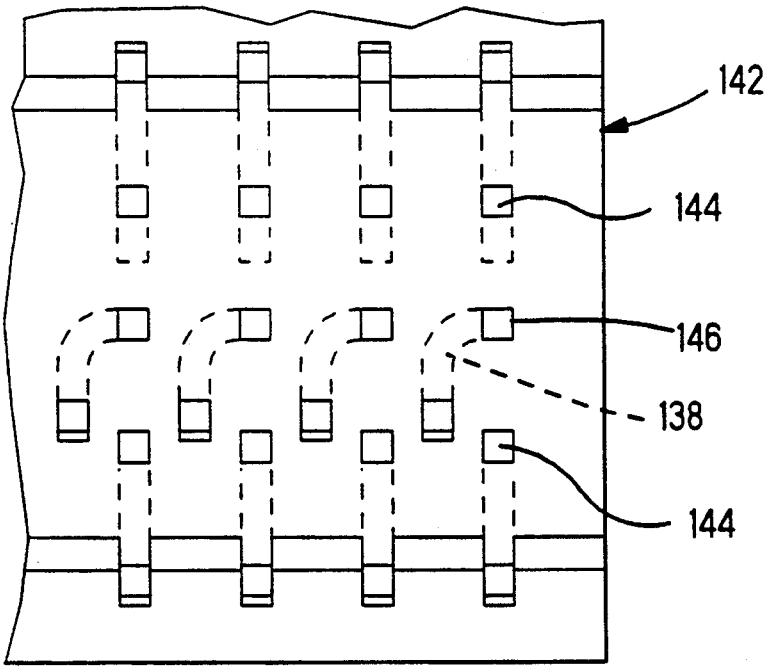
FIG. 10 is a top plan view of the mating face of the alternative embodiment as shown in FIG. 8.
Figure 11:
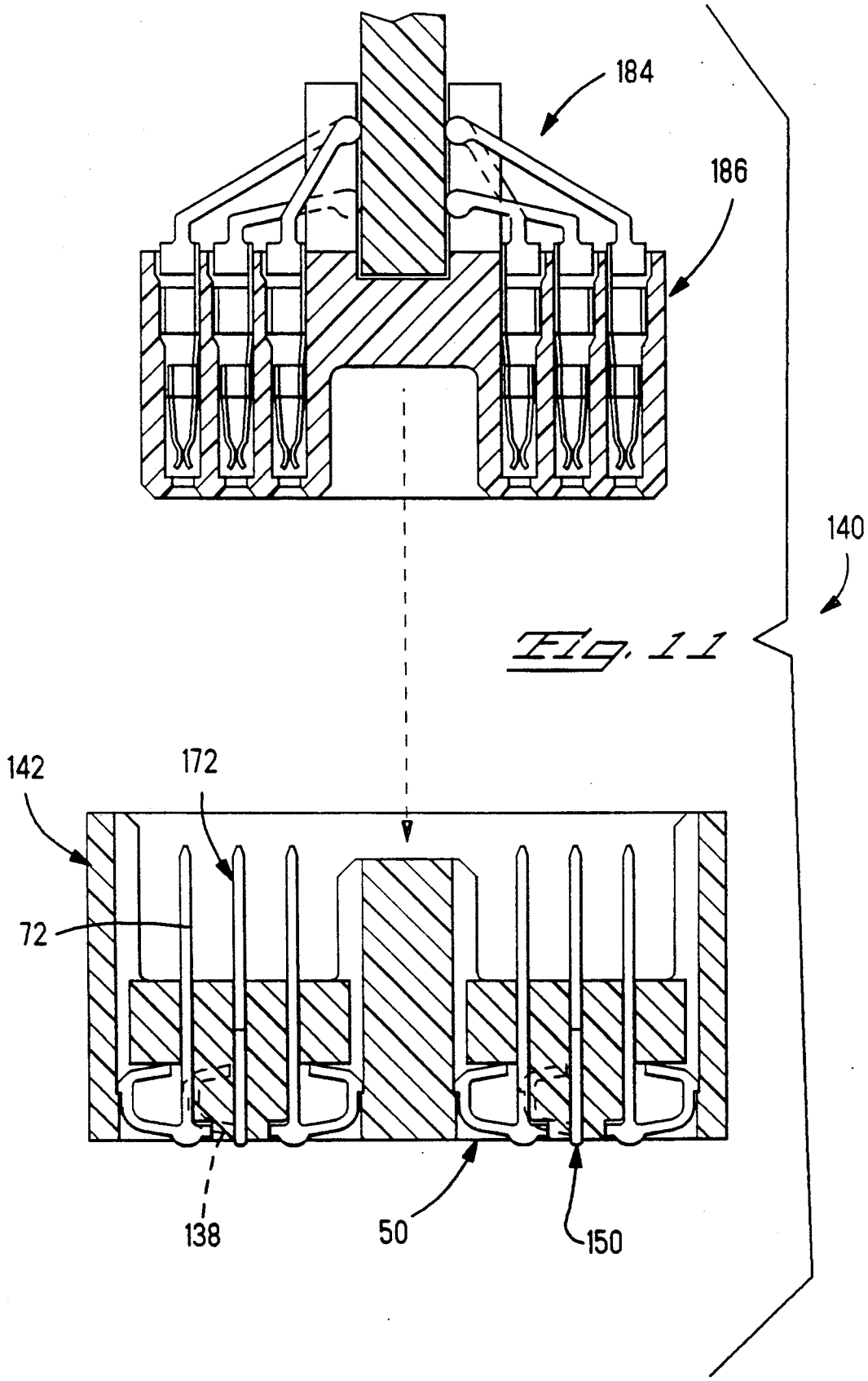
FIG. 11 is a cross sectional view of connector assembly of FIG. 8 with the connectors exploded from each other.

FIGS. 8 through 11 illustrate an alternative embodiment of the present invention in which there are three adjacent rows of terminal members 144,146,144, the first and third rows 144 being identical to the first terminal members 50 in the previously discussed embodiment and an alternative embodiment 150 in the middle row 146. The alternative embodiment 150 is substantially identical to terminal member 50 except that the spring arm portion 160 is curved to fit between the terminal members 50 as is seen in FIGS. 10 and 11. As best seen from the top plan view of FIG. 10, the spring arm receiving recesses 138 are also curved to receive alternate terminal embodiment 150. Alternative terminal member 150 includes a first connecting portion 152 and a spring member 160 having a first transverse arm 162, an axially extending arm 164 and a second transverse arm 168. FIG. 11 shows a cross-sectional view of connector assembly 140 including header 142 and mating connector 184. Header connector includes alternative terminal members 150 disposed between two rows of terminal members 50. The mating connector 184 includes three rows of terminal members 186, which are adapted to mate with the corresponding mating terminal members 50, 150 in header 140.

As can be appreciated from the foregoing description, the surface mounted terminal members 50 of the header 22 include means whereby the body section 52 of the terminal member 50 provides a direct current path between the mating connectors and the corresponding circuits on the board. The spring arm sections 60 provide compliancy to ensure engagement of the first connecting portions 54 of the first terminal members 50 with the circuit pads 122 while remaining remote from the current being conducted through the terminal member 50.

The present invention provides a spring arm terminal that has the increased compliancy associated with spring arms without increasing the length of the current path nor affecting the range of manufacturing and assembly tolerances.

It is thought that the electrical connector assembly of the present invention and many of its attendant advantages will be understood from the foregoing description. Changes may be made in the form, construction, and arrangement of parts thereof without departing from the spirit of the scope of the invention or sacrificing all of its material advantages.

What is claimed is:

1. A connector assembly comprising:

a housing including an array of at least first terminal-receiving passageways extending therethrough from a mating face to a mounting face and an array of at least first spring arm receiving recesses at least adjacent to said mounting face, one of each of said first recesses being associated with and in communication with each said first passageway;

an array of at least first terminal members, each having an axially extending body section having first and second opposed ends defining first and second contact sections, said first contact section being adapted for surface mount engagement with a corresponding contact pad of a circuit board, said first terminal members being disposed in associated ones of said first passageways of said housing such that said first contact section extends slightly beyond said mounting face for circuit board engagement, each said first passageway being dimensioned to be just larger than the dimension of the terminal body section permitting insertion therethrough from said mounting face during assembly, said first terminal members further including a stop surface proximate said first contact section and cooperable with a corresponding stop means within said housing to stop axial movement in a direction from said mounting face to said mating face;

each said first terminal member further including a spring arm having a first transverse portion extending laterally from said first end of said body section, an axial portion of a selected length extending toward said second end from said first transverse portion, and a second transverse portion extending toward said body section and angled slightly toward said second end, said first transverse portion extending essentially parallel to said mounting face and recessed therefrom, said second transverse portion being adapted to engage with a biasing surface of said housing and said axial portion including a retention means facing said mounting face and cooperating with retention means of said housing to stop axial movement of said spring arm in a direction toward said mounting face; whereby upon mounting said connector to said circuit board with said first contact section mated to said corresponding circuit pad, said biasing surface of said housing engages said second transverse portion and exerts pressure thereagainst to bias said first contact section against said circuit pad, said spring arm providing increased normal force to the contact interface while remaining outside the path of the flow of current between the terminal and the circuit pad.

2. The connector assembly of claim 1 further including an array of second terminal members disposed within second terminal-receiving passageways within said housing, said second terminal members being disposed between rows of said first terminal members.

3. The connector assembly of claim 2, wherein said second terminal members define ground means for said assembly.

4. The connector assembly of claim 2 wherein each said second terminal member includes an axially extending body section having first and second opposed ends defining first and second contact sections, said first contact section being adapted for surface mount engagement with a corresponding contact pad of a circuit board and further including a spring arm having a first transverse portion extending laterally from said first end of said body section, an axial portion of a selected length extending toward said second end from said first transverse portion, and a second transverse portion extending toward said body section and angled slightly toward said second end, said first and second transverse portions further including arcuate sections.

* * * * *